US005630895A

United States Patent [19]

Zeidler

[11] Patent Number: 5,630,895

[45] Date of Patent: May 20, 1997

[54] METHOD TO USE HIGH TEMPERATURE PRESSURE ROLLER TO MAKE STATIONARY STRUCTURE COVERING MATERIALS

[76] Inventor: Bernard Zeidler, 150-15-72 Rd, STA, Flush, N.Y. 11367

[21] Appl. No.: 519,744

[22] Filed: Aug. 28, 1995

Related U.S. Application Data

[60] Division of Ser. No. 226,078, Apr. 11, 1994, which is a continuation-in-part of Ser. No. 926,196, Aug. 7, 1992, abandoned.

[51] Int. Cl.[6] ..... E04B 1/64

[52] U.S. Cl. ..... 156/71; 427/186

[58] Field of Search ..... 156/71, 283, 309.6, 156/323; 264/112, 126; 427/186, 194, 195, 138, 139, 155, 202, 206, 203, 208

[56] References Cited

U.S. PATENT DOCUMENTS

| | | | |
|---|---|---|---|
| 3,007,379 | 11/1961 | Ellis | 404/95 |
| 3,762,975 | 10/1973 | Iwasaki et al. | 156/71 |
| 3,844,878 | 10/1974 | Price | 156/71 |
| 4,599,258 | 7/1986 | Hageman | 156/71 |
| 5,370,756 | 12/1994 | Buis et al. | 156/71 |

*Primary Examiner*—Michael W. Ball
*Assistant Examiner*—Michael A. Tolin
*Attorney, Agent, or Firm*—Judith Adele Plotkin

[57] ABSTRACT

A novel heater roller system capable of reaching temperatures in excess of 400 degrees Centigrade is used in situ to prepare highly weather resistant polymeric covering materials by compressing and fusing a layer of fibers and fiber particles by heating the layer through an overlayer of an air-impermeable, heat tolerant material such as aluminum. The fiber layer may contain reinforcing fibers, heat conductive metal flakes, and/or other additives. Such a layer is particularly useful as a roof covering material made in situ.

6 Claims, 1 Drawing Sheet

FIG. 1
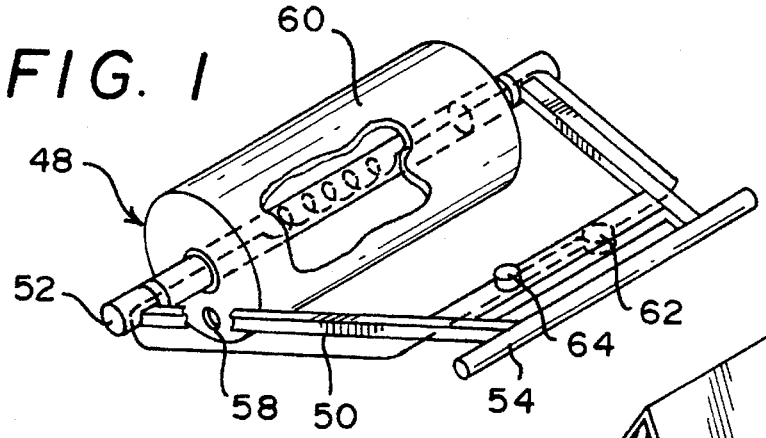
FIG. 2
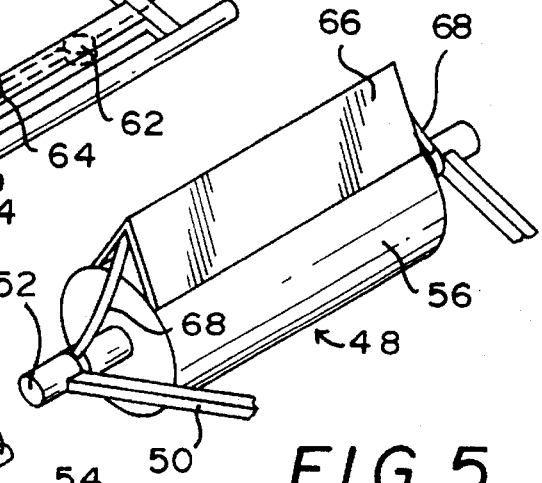
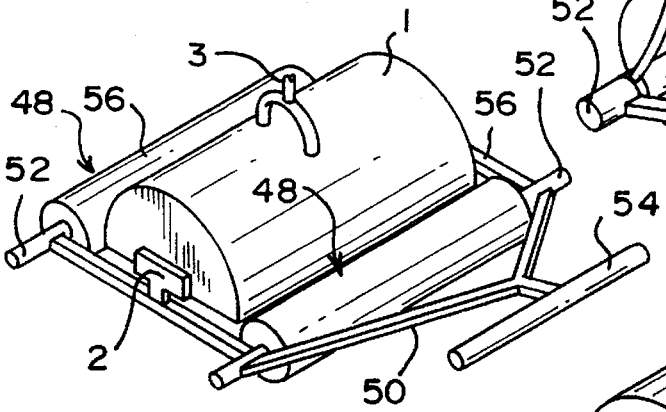
FIG. 3
FIG. 5
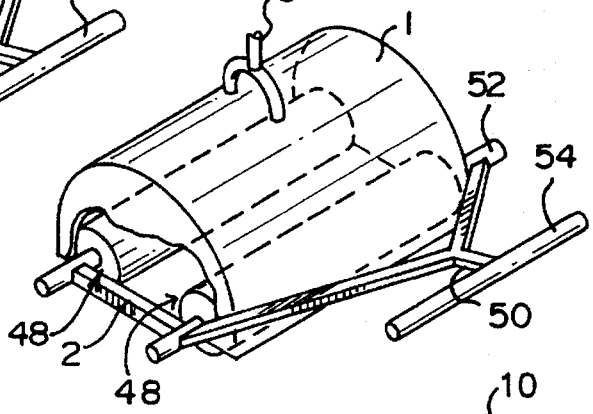
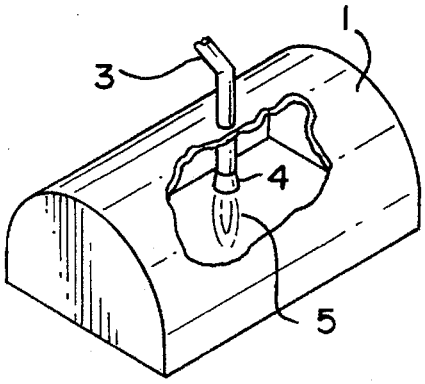
FIG. 4
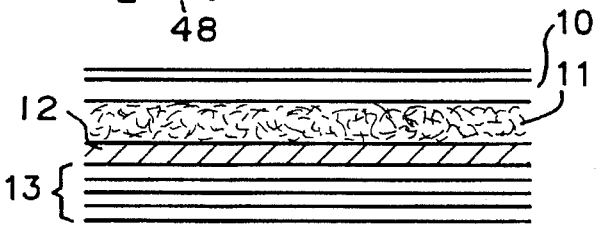
FIG. 6
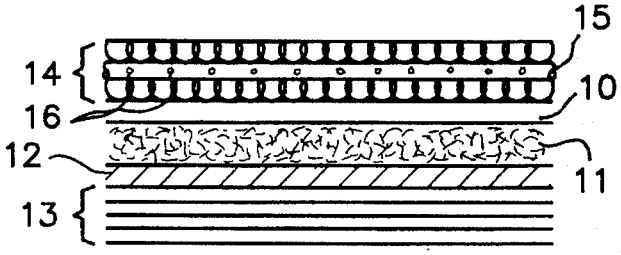
FIG. 7

METHOD TO USE HIGH TEMPERATURE PRESSURE ROLLER TO MAKE STATIONARY STRUCTURE COVERING MATERIALS

This is a division of U.S. application Ser. No. 08/226,078, filed on Apr. 11, 1994 which is a continuation-in-part of U.S. application Ser. No. 07/926,196, filed on Aug. 7, 1992, abandoned.

BACKGROUND

The novel invention herein described relates to an apparatus useful in making highly weather resistant structure covering materials in situ, a method for using such an apparatus, and products made with such an apparatus. These covering materials are particularly useful as roofing layers. The conventional means to prepare roof covering materials have not included in situ preparation under high temperature conditions. When heated rollers have been used for sealing and fusing purposes, they have been used at temperatures below 400 degrees Centigrade.

SUMMARY

A primary object of the present invention is to provide novel weather resistant covering materials for a water, fire and heat proof roof that will overcome the shortcomings of the prior art.

Another object of the present invention is to provide a novel apparatus with which to make such weather resistant covering materials. This apparatus is a high temperature pressure roller system which can be manually propelled or self-propelled (eg.by a motor). Guidance of this apparatus can be by hand or by remote control.

A further object is to provide a method with which to prepare the novel weather resistant covering materials in situ. This method uses the novel apparatus in the preparation of the covering materials.

A still further object is to provide a simple and easy way to prepare roof covering materials which is also economical. Additional objects of the invention will become apparent from the specifications.

To accomplish the above and related objects, this invention can be embodied in forms illustrated in the Figures. However, these figures are illustrative only. Changes within the scope of this specification can be made in the specific constructions illustrated and described within the appended claims.

BRIEF DESCRIPTION OF THE FIGURES

FIG. 1 is a diagramatic perspective of a hot oil heater roller.

FIG. 2 is a diagramatic perspective view of just the tank assembly showing a two blade scraper applied to the cylinder tank to keep it clean.

FIG. 3 is a diagramatic perspective of an embodiment including two heater rollers with a hood therebetween.

FIG. 4 depicts an area under the hood of FIG. 3 which contains a burner section.

FIG. 5 is a diagramatic perspective of an embodiment including two heater rollers within a heated hood structure.

FIG. 6 shows the layer structure used with the high temperature treatment, including a heat-tolerant air-impermeable overlayer, a layer of fibers, an optional non-heat conductive underlayer, and other layers of roof covering materials as desired.

FIG. 7 shows the layer structure of FIG. 6 including the non-heat conductive underlayer and a sponge wetting system with embedded pipes.

DETAILED DESCRIPTION OF THE PREFERRED EMBODIMENTS

The present invention can be used in a roof covering system comprising a plurality of waterproof roof covering materials applied to a roof in which at least one of the upper layers is a sprayed laminated polymer sheet. This at least one upper layer is made in situ from a layer of fiber particles compressed, fused, and dried during the application of heat by a high temperature pressure roller. Preferred embodiments are detailed below.

The roof covering materials can additionally be covered by a layer of sponge in a flat frame, wetted by one or more sprinklers with water from a tank which also has room for collected rain water. Alternatively, a sponge layer for this purpose as seen in FIG. 7 (14) can have an embedded network of hoses or pipes (15) with multiple holes (16) through which water can flow to keep the sponge (17) appropriately wetted with temperature controlled water from a water storage/collection tank. For instance, the water used can be hot during winter freezes and cold during heat waves.

The layer or layers made in situ comprise polymeric fibers compressed, fused and dried through use of a high temperature roller system, examples of which are depicted in FIGS. 1–5. The polymeric fibers optionally can be mixed with reinforcers such as fiberglass. Heat conductive metal particles also optionally can be mixed with the fibers. Polyester fibers can be used to give a thermoplastic product layer.

To use the heat treatment provided by the high temperature roller, caution should be taken not to burn the polymer or other layers. The following method of treatment provides for such caution.

A layer of the optionally reinforced polymeric fibers is spread out upon the already present covering materials in all desired areas for coverage. As depicted in FIGS. 6–7, a heat tolerant, air-impermeable layer(10) such as aluminum is placed over the layer of fibers and/or fiber particles (11). Layer 10 can be made of sublayers of appropriate characteristics if so desired. Depending on the heat resistance characteristics of the underlayers (13), an optional underlayer (12) which is highly heat tolerant and poorly conductive can be laid down prior to the spreading of the fibers and fiber particles. A high temperature roller system is then passed over the layer combination in order to compress, fuse, and dry the fiber containing layer in situ. If desired, after the heat treatment is completed, the overlayer (10) can be removed. The resulting polymeric layer is highly resilient and weather resistant without the need for sealed seams as there are no sections to be joined or overlapped.

One embodiment of the high temperature roller is depicted in FIGS. 1 and 2. In this embodiment, the roller (48) is comprised of a housing (50) having an axle (52) and a handle (54). A rotatable, cylindrical tank (56) is on axle 52. The tank (56) has an opening (58) which can be used to fill the tank with an organic fluid such as an oil or a paraffin and for draining it as needed. A heating coil (60) is within axle (52). A thermostat (62) is electrically connected to heating coil (60). A control knob (64) is electrically connected to both heating coil (60) and thermostat (62).

A person can grip handle (54) to roll heated cylindrical tank (56) over the layer combination. The roller (48) can be propelled by a person or self-propelled (not shown). Further, roller (48) can be guided by a person or, optionally, by remote control when self-propelled. Such a roller can be of any size as needed for use on other surfaces of structures (such as walls, ceilings, parapets, decks, floors, edges, hulls, etc.) to provide a waterproof layer.

A two bladed scraper (66) can be placed on axle 52 of the housing (50) to clean heated, cylindrical tank (56) when the tank is rolled over roof covering materials, The scraper can be spring biased (68) on axle 52.

Two or more high temperature rollers as described above can be anchored to a common frame to be rolled simultaneously over the roof covering materials. In another embodiment, such a multiple roller system can have a hooded structure with at least one burner inside. The hooded structure (1) is attached to the frame (2) between two rollers (48) as depicted in FIG. 3. A means to provide fuel to the at least one burner is included (3). A preferred fuel is a mixture of acetylene and oxygen. In FIG. 4, a burner (4) to provide a heating flame (5) can be seen in a cut-away. Fuel-line 3 is connected to the burner (4). More than one burner in a variety of configurations can be used.

Appropriate fuel control means are included which can be temperature responsive in order to maintain a desired level of heating. This embodiment allows for heating with both the hot oil rollers and the hooded burner(s). However, heating also can be done with just the hooded burner(s) or with only one or more hot oil rollers. Additionally, heating by the rollers and burners can be independently and repeatedly turned on and off during any given heat treatment.

Yet another embodiment is depicted in FIG. 5. In this case, the heater rollers (48) are not filled with oil and are covered by hooded structure (1) attached to a common frame (2). The rollers (48) can be heated internally by heater coils (not shown) or externally by the burner(s) (not shown) fed fuel by fueling means 3 or by both ways.

The temperature used and the time of heat exposure can be adjusted according to the types of fibers used. After high temperature heat treatment, the fiber layer has been compressed and fused into a waterproof, resilient and weather resistant layer more durable than previously used polymeric roof covering materials.

The embodiments described above and in the claims which follow are illustrative of the novel features of this invention. Althogh the preferred embodiments of the present invention have been fully described with reference to the accompanying drawings, various changes and modifications are apparent to those skilled in the art. Such changes and modifications are to be understood as within the scope of the present invention as defined by the appended claims, unless they depart therefrom,

What is claimed is:

1. A method to compress and fuse polymeric fibers in situ into a highly weather resistant, seamless, covering layer for the surface of a permanent structure using a propelled heater roller, said method comprising:

a) optionally placing on the areas to be covered on said surface a heat tolerant and poorly heat conductive underlayer;

b) placing a fiber layer comprised of said fibers over the area to be covered on said surface;

c) covering said fiber layer with an air-impermeable overlayer of high temperature tolerant material; and d) concurrently compressing and fusing said fiber layer by in situ exposure through said air-impermeable layer to high temperatures applied by said heater roller in order to uniformly melt and fuse said fibers into a waterproof layer on said surface of said permanent structure.

2. A method to compress and fuse polymeric fibers in situ into a highly weather resistant, seamless covering layer for the surface of a stationary structure using a propelled heater roller, said method comprising:

a) optionally placing on the stationary surfaces to be covered a heat tolerant and poorly heat conductive underlayer;

b) placing a fiber layer comprised of said fibers over the stationary surfaces to be covered;

c) covering said fiber layer with an air-impermeable overlayer of high temperature tolerant material;

d) concurrently compressing and fusing said fiber layer by in situ exposure through said air-impermeable layer to high temperatures applied by said heat roller in order to uniformly melt and fuse said fibers into a waterproof layer on said surface of said stationary structure; and e) optionally removing said overlayer once melting, fusion, compression and drying have been completed; wherein said underlayer protects heat intolerant components of said structure from said high temperatures needed to uniformly melt, fuse, compress, and dry said fibers in situ into a highly weather resistant, waterproof, and seamless covering layer for the surface of said stationary structure.

3. A method as recited in claim 1 in which said polymer fibers are selected from the group consisting of polyesters, polyesters reinforced with fiberglass, polyesters mixed with metal particles, and combinations thereof.

4. A method as recited in claim 2 in which said polymeric fibers are selected from the group consisting of polyesters, polyesters reinforced with fiberglass, polyesters mixed with metal particles, and combinations thereof.

5. A method as recited in claim 1 in which said waterproof and seamless covering layer is thermoplastic.

6. A method as recited in claim 2 in which said waterproof and seamless covering layer is thermoplastic.

* * * * *